US007452132B2

(12) United States Patent
Tang

(10) Patent No.: US 7,452,132 B2
(45) Date of Patent: Nov. 18, 2008

(54) CLOTHES STORAGE BAG

(76) Inventor: Wen-Chin Tang, 12F, No. 356, Ming Chih Rd., Tai Shan Hsiang, Taipei Hsien (TW)

( * ) Notice: Subject to any disclaimer, the term of this patent is extended or adjusted under 35 U.S.C. 154(b) by 462 days.

(21) Appl. No.: 11/002,088

(22) Filed: Dec. 3, 2004

(65) Prior Publication Data

US 2006/0120631 A1 Jun. 8, 2006

(51) Int. Cl.
*B65D 33/16* (2006.01)
*B65D 33/01* (2006.01)
*B65D 30/16* (2006.01)

(52) U.S. Cl. ..... 383/63; 383/100; 383/103; 383/104

(58) Field of Classification Search ..... 383/66, 383/63, 101, 102, 103, 104, 121, 121.1, 122
See application file for complete search history.

(56) References Cited

U.S. PATENT DOCUMENTS 2,865,768 A * 12/1958 Barnes et al. ..... 426/111
3,516,217 A * 6/1970 Gildersleeve ..... 53/399
4,358,466 A * 11/1982 Stevenson ..... 426/106
4,570,820 A * 2/1986 Murphy ..... 221/34
4,810,844 A * 3/1989 Anderson ..... 219/727
4,904,093 A * 2/1990 Woods et al. ..... 383/120
4,950,859 A * 8/1990 Anderson ..... 219/727
5,540,500 A * 7/1996 Tanaka ..... 383/43
5,701,996 A * 12/1997 Goto et al. ..... 206/287
5,881,881 A * 3/1999 Carrington ..... 206/524.8
6,116,781 A * 9/2000 Skeens ..... 383/100
6,357,915 B2 * 3/2002 Anderson ..... 383/100
6,499,600 B2 * 12/2002 Koyanagi ..... 206/524.8

* cited by examiner

*Primary Examiner*—Jes F Pascua
(74) *Attorney, Agent, or Firm*—Lowe Hauptman Ham & Berner

(57) ABSTRACT

A clothes storage bag permitting the stacking of clothes in standing position is comprised of two side plastic films and a base plastic film; both side films defining an erected storage case on the upper part; a zipper sealing being provided to an opening at the top of the erected storage case; the lower part of each erected film laterally extending in opposite directions to form a lateral storage case connecting through the erected storage case; and a passage to expel air being provided on either side of the lateral storage case to reduce bag size.

1 Claim, 7 Drawing Sheets

CLOTHES STORAGE BAG

BACKGROUND OF THE INVENTION (a) Field of the Invention

The present invention is related to a clothes storage bag, and more particularly, to one that allows neat stacking of multiple pieces of clothes for storage in reduced volume by easy expelling the air in the bag.

(b) Description of the Prior Art

As illustrated in FIG. 8, a clothes storage bag for domestic or traveling purpose is usually comprised of two sheets of plastic film 10 arranged in parallel and welded to each other at their edges leaving an opening provided at one end functioning a an inlet 20 with a zipper 30, and a ventilation passage 40 disposed at the opposite end. With clothes stored, the bag is rolled up to expel extra air in the bag for reduced volume.

Since the storage bag of the prior art is flat, the space defined by two sheets of plastic film 10 is confined to provide sufficient space for the storage of more clothes, and is very awkward to stuff heavier clothes such as overcoat. Furthermore, the air in the bag can only be expelled through the ventilation passage 40 after having the clothes in the bag, the zipper 30 sealed, and the bag rolled up together with the clothes. The bag is then extended and laid flat to be put into the cabinet or a luggage. The whole process of storage consumes a lot of efforts and is very difficult to use in case of heavier clothes.

SUMMARY OF THE INVENTION

The primary purpose of the present invention is to provide an improved construction of a bag for storage of clothes that accommodates more clothes and easily expel excessive air for storage.

Another purpose of the present invention is to provide an improved clothes storage bag that allows a standing position for storage of clothes, and the bag is then placed upside down to directly expel the air in the bag for economized efforts.

Another purpose yet of the present invention is to provide an improved clothes storage bag that is a summary type exclusively for traveling purpose.

DETAILED DESCRIPTION OF THE PREFERRED EMBODIMENTS

Figure 1:
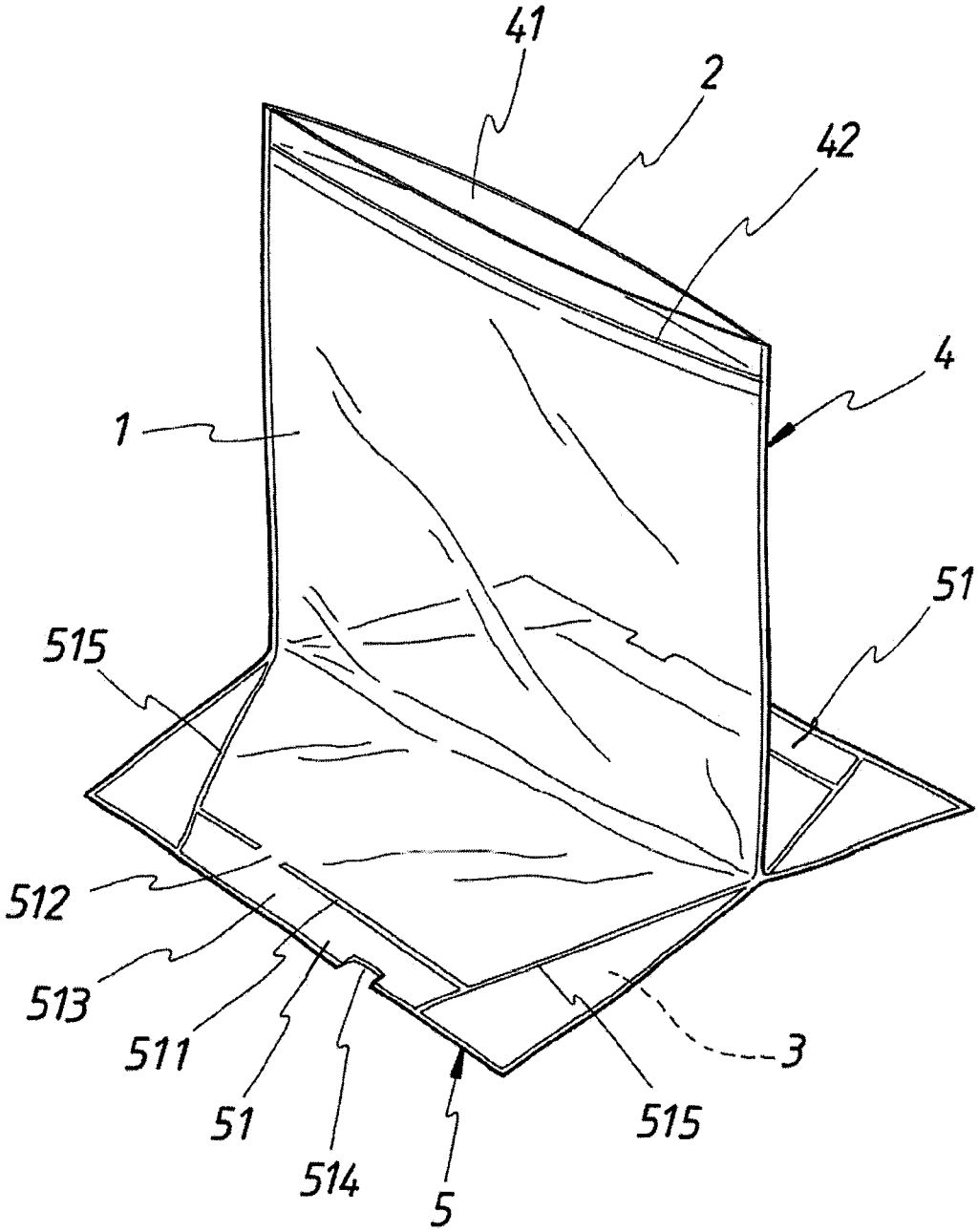
FIG. 1 is a perspective view of the present invention.
Figure 2:
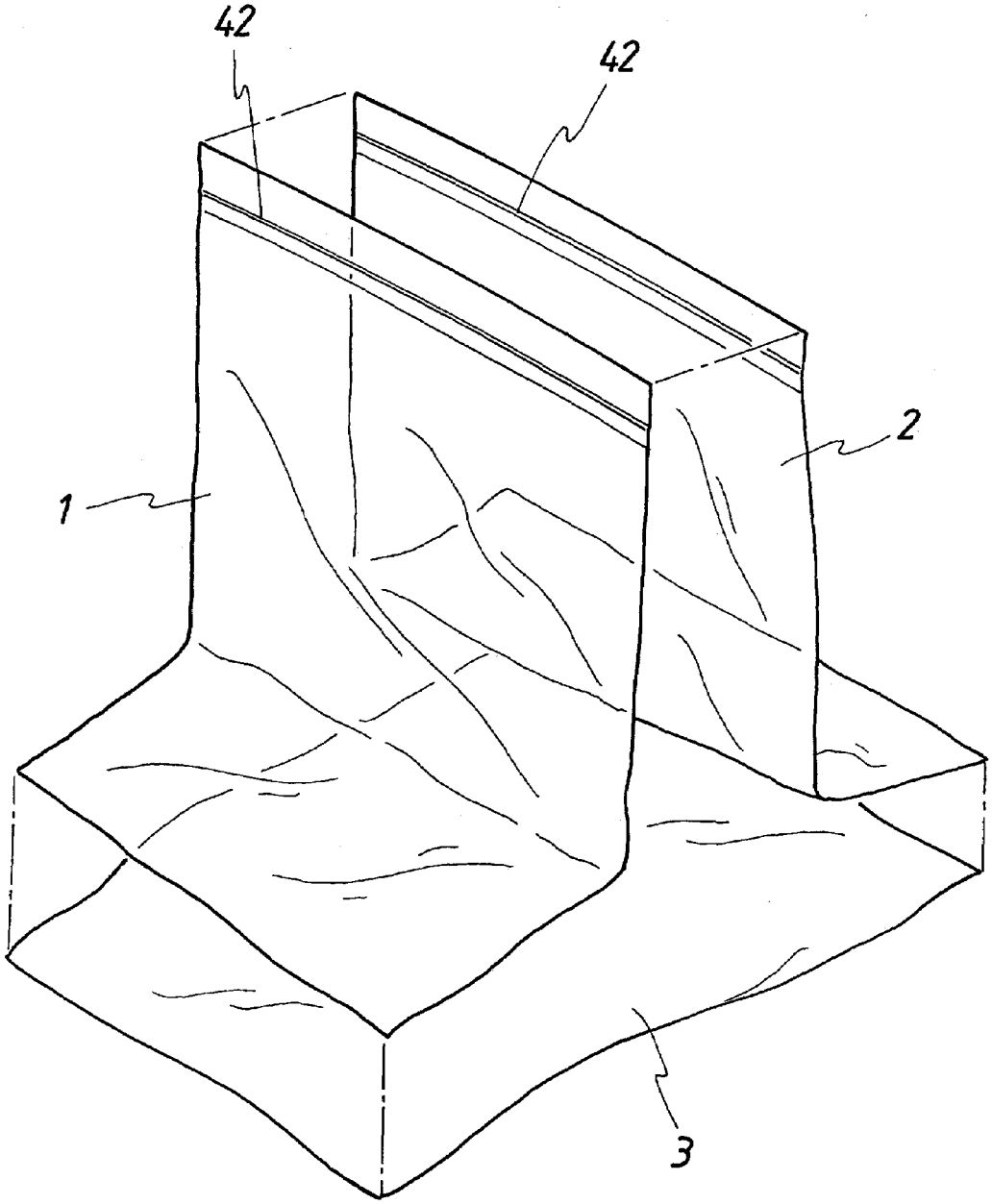
FIG. 2 is a schematic view showing an application of the present invention.
Figure 3:
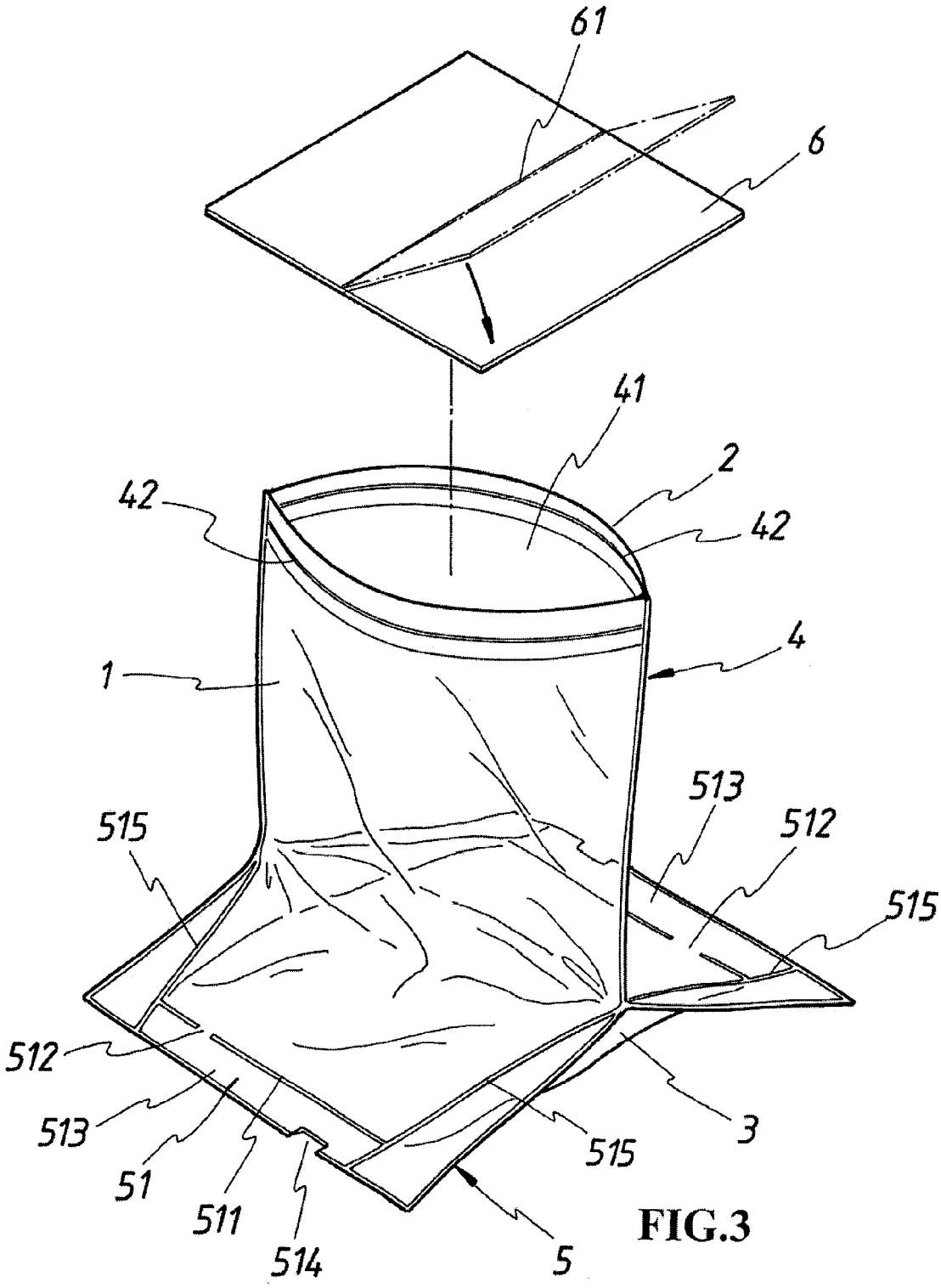
FIG. 3 is a schematic view showing the application of the present invention in conjunction with a pressboard.

Referring to FIGS. 1 and 2, a preferred embodiment of the present invention is comprised of two sheets of side plastic films 1, 2 welded to each other, and a sheet of base plastic film

3 to define an erected storage case 4 and a lateral storage case 5 connected through each other adapted with a pressboard 6.

Both sheets of side plastic films 1, 2 are abutted to each other in parallel on their both sides by welding as illustrated in FIG. 2 to define the erected storage case 4. An opening 41 as illustrated in FIG. 1 is formed at the top of the erected storage case 4 and a zipper sealing 42 is provided on the inner walls of both side plastic films 1, 2 at where close to the opening 41. The lower end of the erected storage case 4 is connected through the lateral storage case 5 in a form that merely permits the lower ends respectively of both side plastic films 1, 2 are extended outward in opposite directions in corresponding to the base plastic film 3 as illustrated in FIG. 2 while the peripheral of the lower ends of both side plastic films 1, 2 are welded to that of the base plastic film 3. A passage 51 to expel air is provided on either side of the lateral storage case 5 as illustrated in FIG. 1.

A press line 511 is formed by welding on either side or each on both edges of the lateral storage case 5; the lower end surfaces of both side plastic films 1, 2 on the selected edge or edges are welded to the base plastic film 3 to segregate a ventilation port 512 at where the press line 511 is interrupted for a section 513 for the reservation of an gap to expel air; and an air outlet 514 is provided on the outer edge of the passage 51 to expel air by the ventilation port 512 to form a one-way passage 51 to expel air that prevents backflow of the air.

Two additional press lines 515 are respectively provided staring from where both sides of the erected storage case 4 are welded to the base plastic film 3 and extending at a certain inclination to both outer sides of the lateral storage case 4 to enclose the corners of the lateral storage case 5; and both surfaces of the lower ends of the side plastic films 1, 2 are welded to the base plastic film 3 to enclose both corners of the lateral storage case 5 to facilitate the storage of clothes neat and secured in position.

Figure 4:
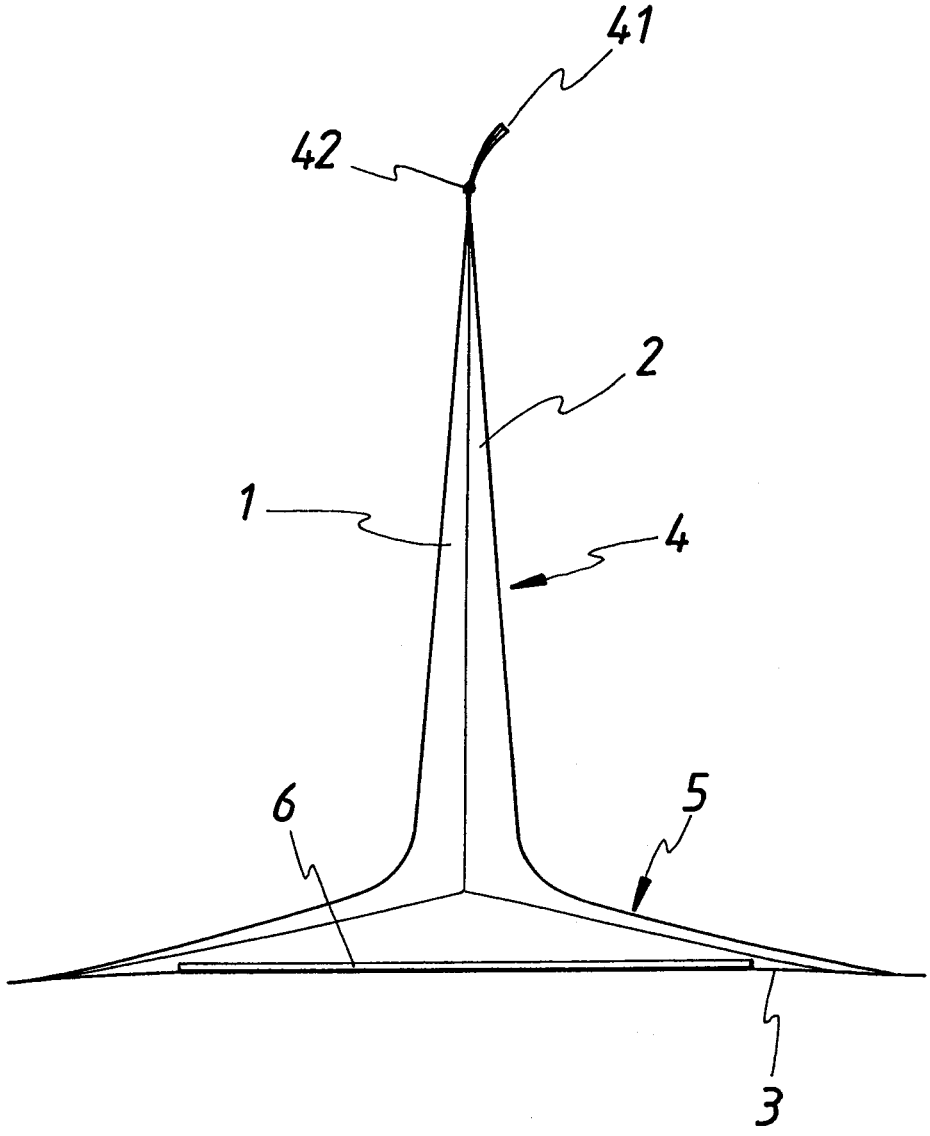
FIG. 4 is a sectional view the application of the present invention in conjunction with a pressboard.
Figure 5:
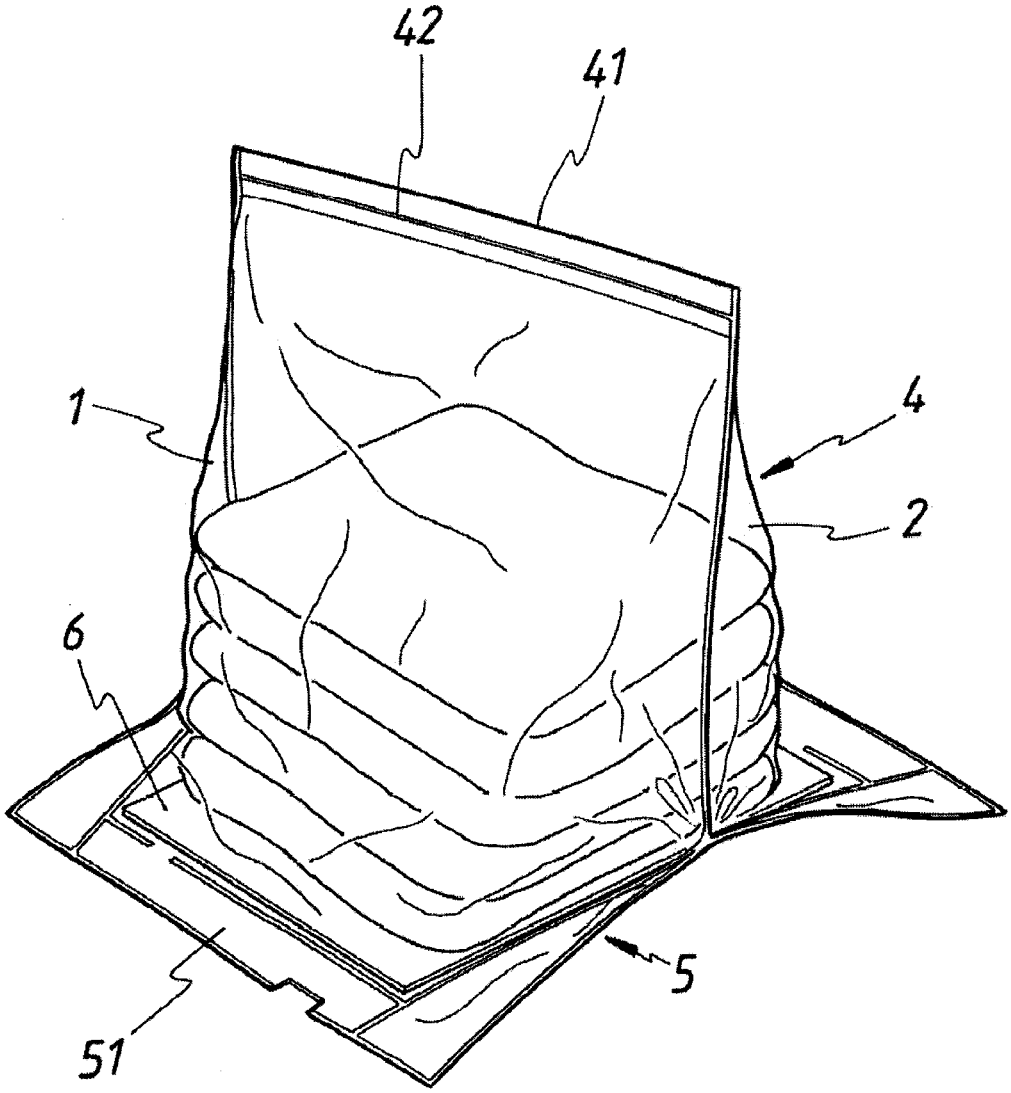
FIG. 5 is a schematic view showing the operation of storage of clothes into the bag of the present invention.

As illustrated in FIGS. 4 and 5, the pressboard 6 is made of plastic material, paperboard 6 or any other hard board is provided on its surface one or multiple folding marks 61 for easy placement in flat into the storage bag to help the user to compress the bag.

In use, multiple pieces of clothes are folded neat, stacked and placed on the pressboard 6 as illustrated in FIG. 5. The erected storage case 4 is stretched up to accommodate the clothes. Once the height of the stacked clothes reaches a certain extent. The zipper sealing 42 is pressed to close up the opening 41 of the erected storage case 4 to improve the insufficiency of accommodating more or heavier pieces of clothes as found with the prior art.

Figure 6:
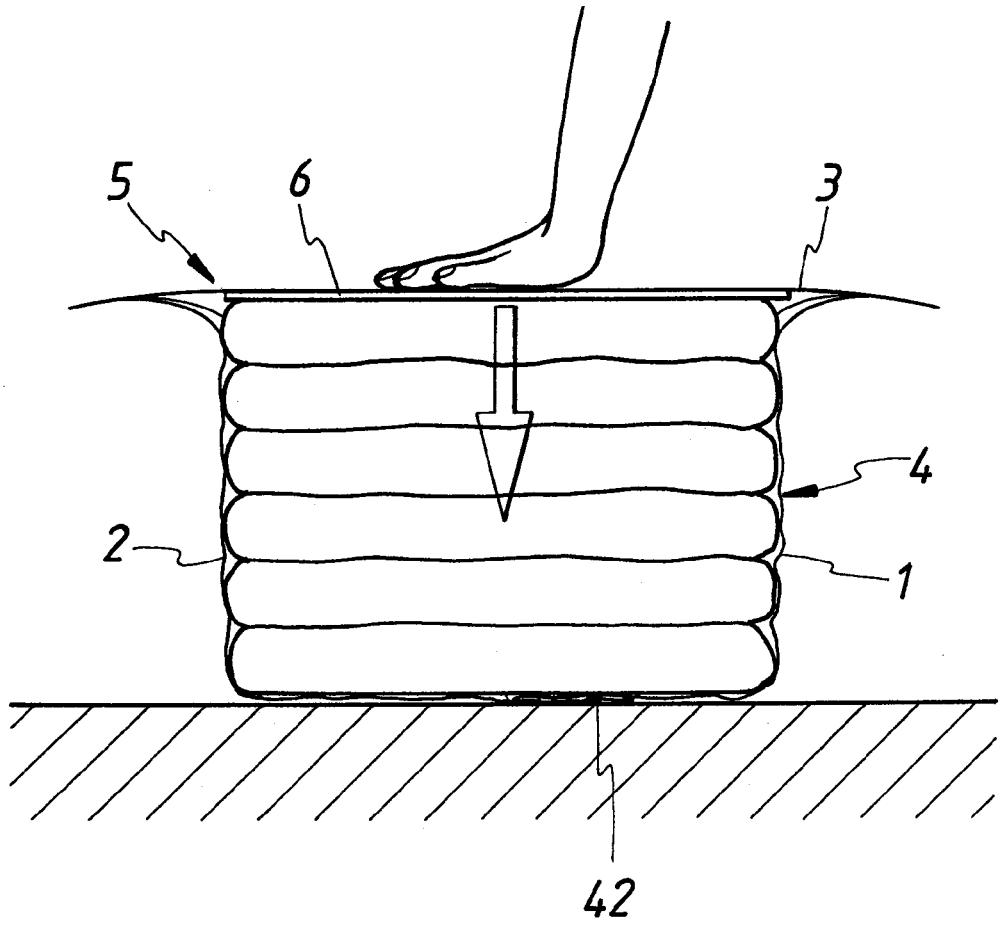
FIG. 6 is a schematic view showing the operation of expelling excessive air in the bag of the present invention.
Figure 7:
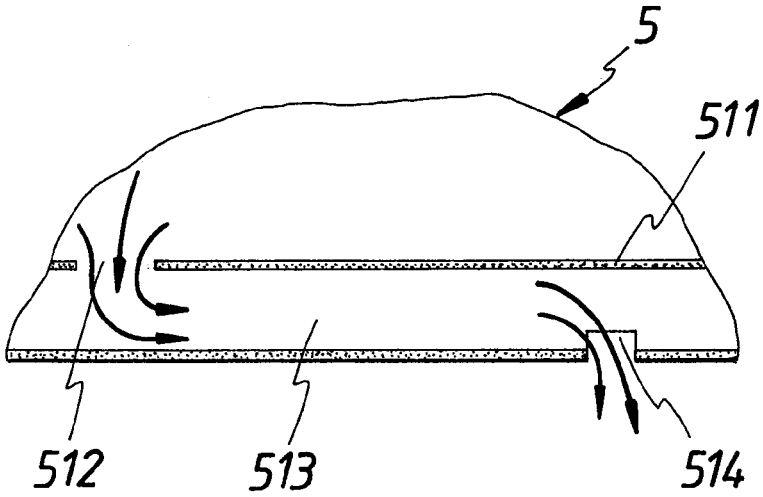
FIG. 7 is a schematic view showing the working principle of expelling excessive air in the bag of the present invention.
Figure 8:
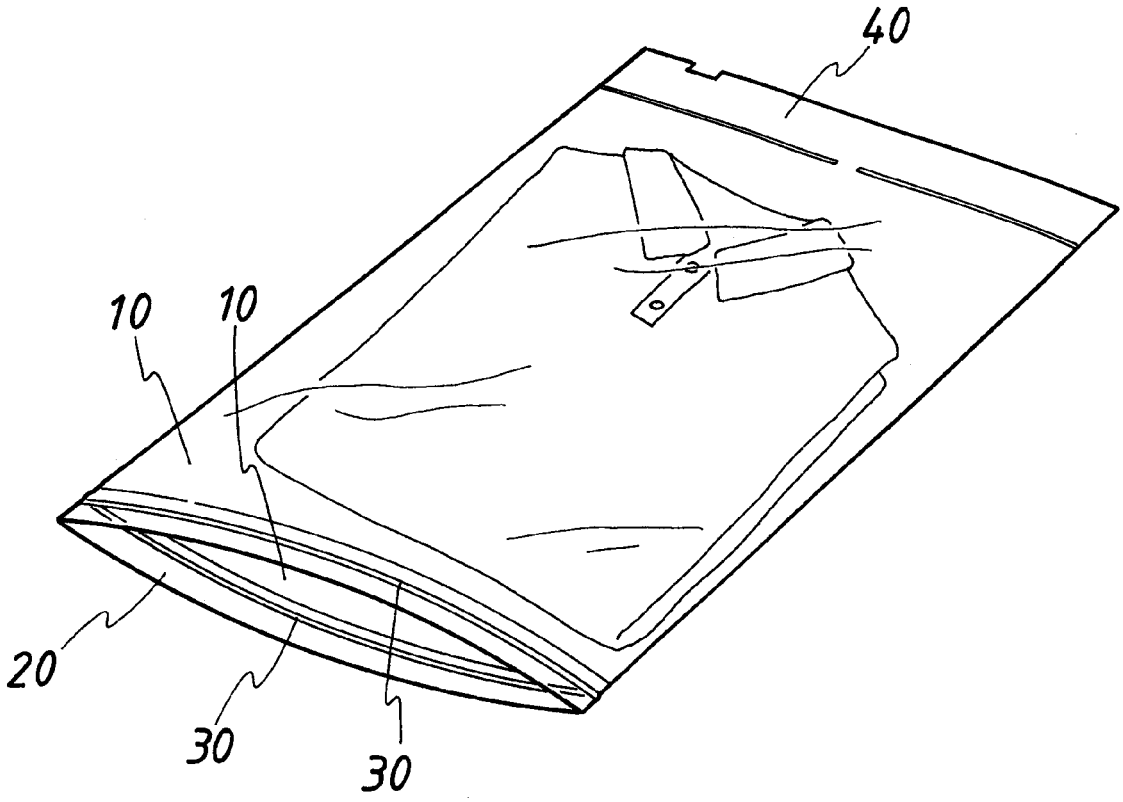
FIG.8 PRIOR ART
FIG. 8 is a schematic view of a clothes storage bag of the prior art.

Now referring to FIG. 6, the storage bag once with its opening 41 sealed is placed up-side down for the use to press on or sit on the pressboard 6 to expel excessive air in the bag to be drained through the section 513, the ventilation port 512 and the air outlet 514 as illustrated in FIG. 7 while preventing the air outside the bag from re-entering into the bag. The economized efforts to expel excessive air in the storage bag of the present invention effectively improve the flaw of consuming too much effort on rolling up the bag observed with the prior art. Accordingly, the present invention provides easy and handy storage of clothes in least space at home or on the road.

What is claimed is:

1. A clothes storage bag including two side plastic films, each of said films having an upper part and a lower part and a base plastic film having a peripheral edge; and both sides of the upper part of each side plastic film welded to form an erected storage case having a top and a lower part; an opening between the two side plastic films provided on the top of the erected storage case; a zipper sealing disposed around the opening; the lower part of each erected plastic film extending laterally in opposite directions to define a lateral storage case connected through the erected storage case in relation to and welded to the peripheral edge of the base plastic film; and a passage to expel air provided in the lateral storage case parallel to but spaced from the peripheral edge for reducing the size of the storage bag and wherein the passage to expel air is formed by a press line welded to either side of the lateral storage case; a ventilation port formed by an interruption of the press line for expelling the excessive air in the bag and an air outlet provided on the edge of the base plastic film to expel air and two additional press lines provided starting from where both sides of the erected storage case are welded to the base plastic film and extending at an inclination to both outer sides of the lateral storage case to enclose the lateral storage case and a press board provided within the lateral storage case.

* * * * *